United States Patent [19]

Delfosse

[11] Patent Number: 4,593,501

[45] Date of Patent: Jun. 10, 1986

[54] VIBRATION AND SHOCK ISOLATOR WITH ADJUSTABLE STIFFNESS

[75] Inventor: Gilles C. Delfosse, Marseille, France

[73] Assignee: Isosys, Inc., Palo Alto, Calif.

[21] Appl. No.: 540,227

[22] Filed: Oct. 11, 1983

[51] Int. Cl.[4] ..... E04H 9/02; E04B 1/36

[52] U.S. Cl. ..... 52/167; 188/378; 248/636; 248/638; 267/136

[58] Field of Search ..... 52/167; 248/558, 636, 248/634, 638, 585, 573; 14/16.1; 188/378, 381, 379; 267/136, 104.4, 104.3

[56] References Cited

U.S. PATENT DOCUMENTS

| | | | |
|---|---|---|---|
| 2,987,291 | 6/1961 | Dyson | 267/140.3 |
| 3,908,054 | 9/1975 | Ito | 14/16.1 |
| 4,117,637 | 10/1978 | Robinson | 52/167 |
| 4,179,104 | 12/1979 | Skinner | 52/167 |
| 4,258,516 | 3/1981 | Mori et al. | 52/167 |
| 4,363,149 | 12/1982 | Kondo et al. | 52/167 |

FOREIGN PATENT DOCUMENTS

| | | | |
|---|---|---|---|
| 552456 | 11/1956 | Belgium | 14/16.1 |
| 58970 | 9/1982 | European Pat. Off. | 14/16.1 |
| 58971 | 9/1982 | European Pat. Off. | 14/16.1 |
| 76573 | 4/1983 | European Pat. Off. | 52/167 |
| 572617 | 9/1977 | U.S.S.R. | 267/136 |
| 632794 | 11/1978 | U.S.S.R. | 14/16.1 |

*Primary Examiner*—Alfred C. Perham

*Attorney, Agent, or Firm*—Townsend and Townsend

[57] ABSTRACT

An isolator for use in protecting buildings and other structures from the effects of vibration and shock due to an earthquake. The isolator comprises a stack of elastic bearings interconnected at their outer peripheries and located between and coupled to an upper plate and a lower plate. The junctions between adjacent elastic bearings and between the upper and lower elastic bearings and the upper and lower plates are provided with intermediate plates extending beyond the outer peripheries of the elastic bearings. The intermediate plates have aligned holes near their outer peripheries for receiving vertical rods whose lower ends are releasably coupled to rod-holding devices mounted on the lower plate. The rods provide lateral stiffness for the isolator and, by proper selection of the lengths of the rods, the stiffness of the isolator can be adjusted as desired. By providing a single isolator body with a given number of elastic bearings and by proper selection of the rod lengths and size, it is possible to provide isolators capable of meeting different design requirements yet all isolators have the same basic body of a given diameter.

4 Claims, 4 Drawing Figures

FIG. 1
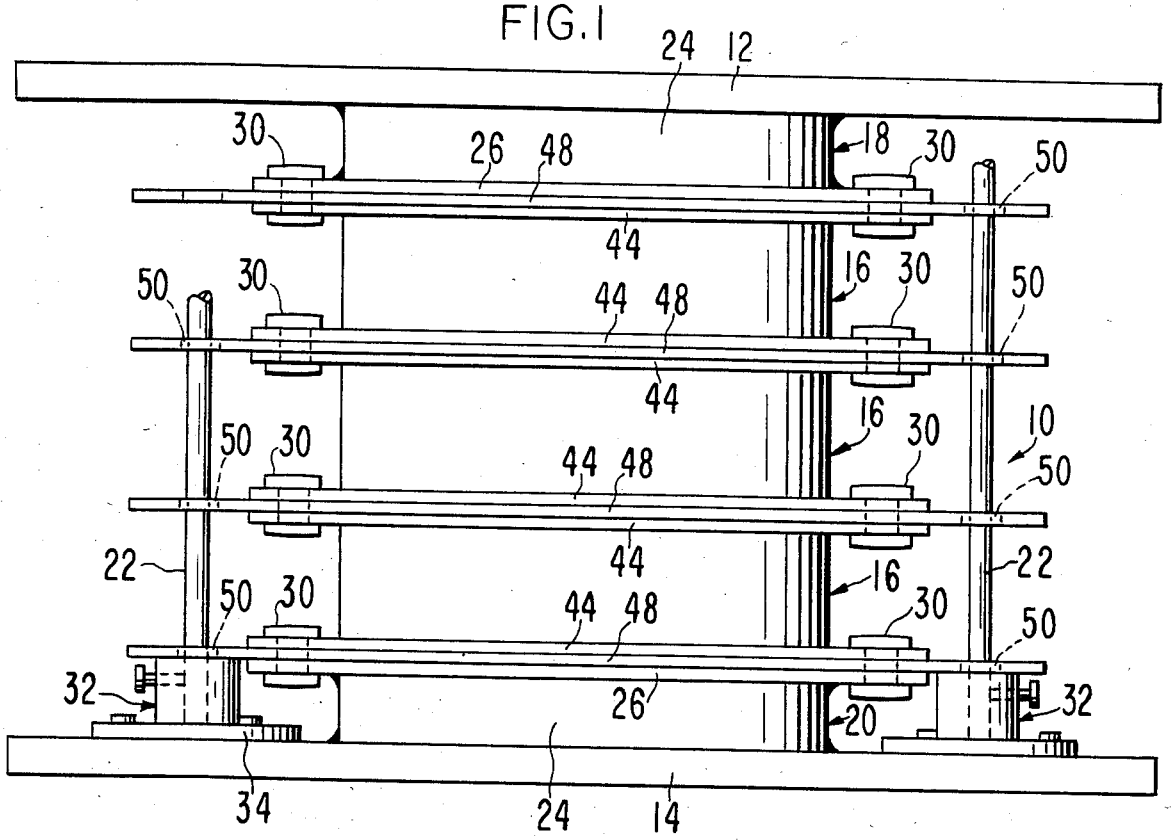
FIG. 2
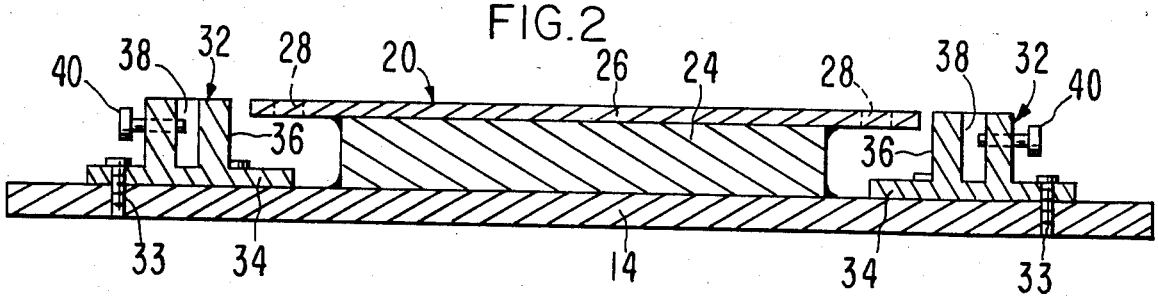
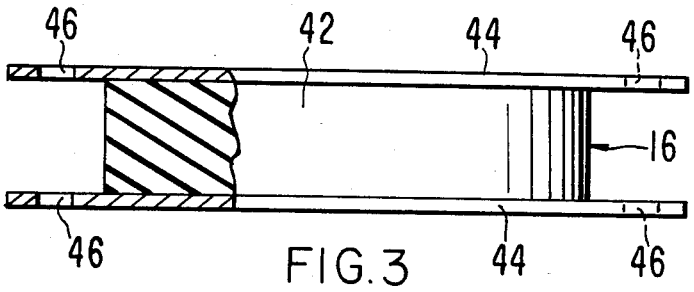
FIG. 3

VIBRATION AND SHOCK ISOLATOR WITH ADJUSTABLE STIFFNESS

This invention relates to improvements in techniques for protecting buildings and other structures from the damaging effects of earthquakes, and more particularly, to a vibration and shock isolator having an adjustable stiffness feature for absorbing energy due to an earthquake.

BACKGROUND OF THE INVENTION

It is well known to provide vibration and shock isolators for buildings and other structures to absorb at least part of the energy due to an earthquake to prevent structural damage. Isolators generally are designed to carry a particular vertical load and to resist a particular horizontal displacement of the supported building or structure. Conventional isolators are typically manufactured to satisfy these particular requirements; thus, for use with buildings of different sizes and during earthquakes of different intensities, many different sizes of isolators must be manufactured and be available in stock so as to to satisfy the various requirements.

It is expensive to stock such a large number of vibration and shock isolators. Also, it is possible that large numbers of stock isolators will be manufactured and never be used because of the lack of demand for them. Because of the expense and inconvenience of stocking a large number of isolators of different sizes, a need exists for a solution to this problem to minimize the expense yet provide isolators especially adapted for specific isolation requirements for buildings and other structures.

SUMMARY OF THE INVENTION

The present invention fulfills this need by providing an improved vibration and shock isolator for use in protecting buildings and other structures from earthquake damage. The isolator of the present invention is provided with means for adjusting the lateral stiffness of the isolator. In this way, an isolator of a single design can be manufactured in volume and, with the adjustable stiffness feature, can be put to use in various applications where isolators of different vertical load and lateral stiffness requirements are needed. Thus, the isolator of the present invention, with its adjustable stiffness feature, can be substantially universally used so as to minimize production costs yet the isolators are suitable for supporting vertical loads of different values to thereby provide a more efficient isolator than is now conventionally available and one which is suitable for use with in many different applications.

The isolator of the present invention is comprised of a vertical stack of elastic bearings which are coupled together at their outer peripheries by bolts or the like. The stack of elastic bearings is between an upper plate and a lower plate, the upper and lower plates being between a support surface and a load to be supported by the isolator.

The isolator is provided between each pair of adjacent elastic bearings with an intermediate plate of an outer peripheral size greater than that of the elastic bearings themselves. Each intermediate plate has a number of outer peripheral holes, and respective holes of the intermediate plates are aligned with each other. One or more rods extend through the intermediate plates, there typically being a rod for each group of aligned holes, respectively. The rods provide lateral stiffness for the isolator, and a single rod or a number of rods can be used to provide a desired lateral stiffness. The lower ends of the rods are removably attached to rod holding devices secured to the lower plate. Also, the lengths of the rods can differ from each other or can be the same, depending upon the stiffness which is to be provided for the isolator.

By properly selecting the number, size, and lengths of the rods, it is possible to provide a vibration and shock isolator having a lateral stiffness falling within a wide range of stiffness values, yet the basic isolator body of a given diameter, that is, the elastic bearings of a given diameter remain identical for all of the isolators. Thus, it is possible to stock only a single basic isolator of a given diameter and to allow that basic isolator to be used in a wide variety of applications by the proper selection of the rods which are coupled to an isolator to provide a specific lateral stiffness therefor.

The primary object of the present invention is to provide an improved vibration and shock isolator having an adjustable stiffness feature which allows a basic isolator body of a given diameter to be produced and kept in stock and such basic isolator body can be used in applications having different stiffness and load requirements by virtue of the adjustable stiffness feature to thereby minimize production costs while providing an efficient isolator.

Other objects of this invention will become apparent as the follow specification progresses, reference being had to the accompanying drawing for an illustration of the invention.

In the Drawings

FIG. 1 is a side elevational view of an isolator of the present invention showing a stack of rubber bearings and the adjustable stiffness means coupled with the rubber bearings;

FIG. 2 is a vertical section through the lower part of the isolator of FIG. 1;

FIG. 3 is a rubber bearing forming a part of the isolator of FIG. 1;

Figure 4:
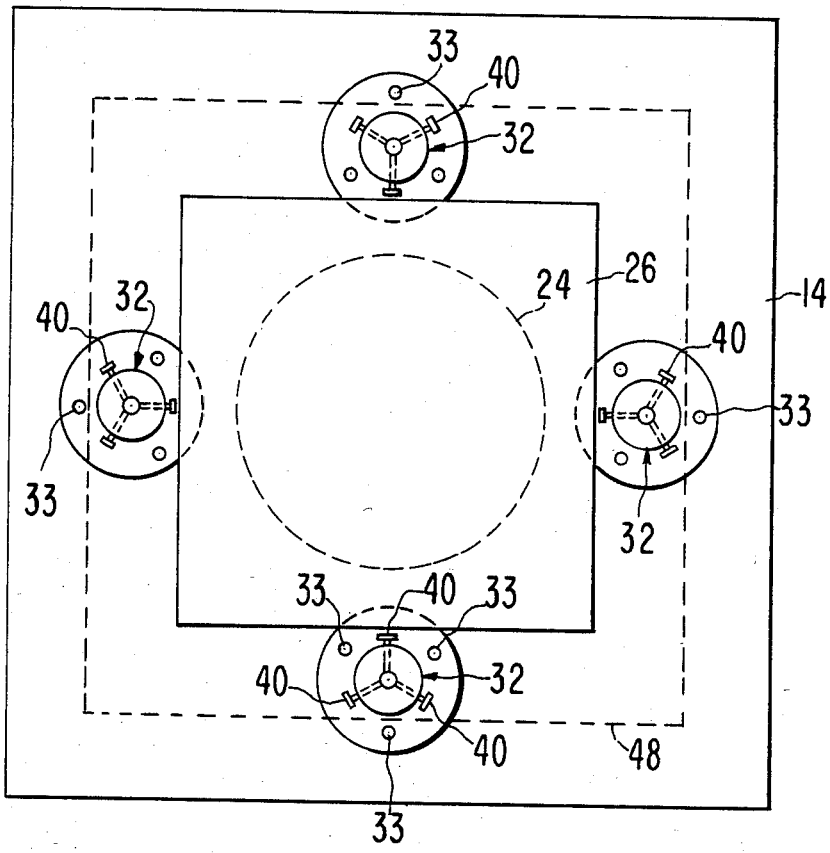
FIG. 4 is a top plan view of the lower part of the isolator without the stack of bearings of the type shown in FIG. 3.

The isolator of the present invention is denoted by the numeral 10 and is shown in its assembled form in FIG. 1. Isolator 10 has upper and lower steel plates 12 and 14. Between plates 12 and 14, there are a number of stacked bearing elements 16, an upper end element 18 and a lower end element 20. A number of vertical, rigid rods 22 are provided as parts of isolator 10 to provide an adjustable stiffness feature for the isolator. Isolator 10 is adapted to be placed between two building parts or below equipment to provide vibration and shock isolation between an upper and a lower part. For purposes of illustration, these parts will be referred to as building parts.

Lower end element 20 is shown in cross-section in FIG. 2. Element 20 includes a flat metallic plate 24 which is welded or attached by screws or bolts to lower plate 14. Typically, flat plate 24 is cylindrical in shape and has a central axis which is generally vertical. A flat, relatively thin plate 26 is welded or bolted to the upper end of plate 24 and has a number of outer peripheral holes 28 therethrough for receiving bolts 30 which connect lower element 20 to the next adjacent bearing element 16 thereabove. Plate 26 typically is square as shown in FIG. 4; however, it can be of other shapes, if desired. The size of plate 26 is less than that of plate 14, the latter being shown in FIG. 4 is also being square.

A number of rod-retaining members 32 are secured by bolts 33 to the upper surface of bottom plate 14 at locations surrounding lower element 20. Each of members 32 includes a lower flange 34 integral with and extending outwardly from a cylindrical part 36 having a central hole 38 for receiving the lower end of a respective rod 22. One or more set screws 40 are used to releasably fix the lower end of a rod 22 in hole 38. Any other clamping means can be used for this purpose.

Each bearing element 16 includes a solid rubber body 42 typically of cylindrical or other shape. Body 42 could be laminated, if desired. Body 42 is sandwiched between two relatively thin, flat plates 44 having aligned holes 46 at the outer peripheries thereof. Plates 44 are typically of the same shape as upper plate 26 of lower element 20, and holes 46 are aligned with holes 28 in plate 26. In this way, bolts 30 can interconnect plate 26 with the next adjacent plate 44. The number and diameter of holes 46 depend upon the intensity of the expected forces to be applied to isolator 10.

A relatively thin plate 48 is located between and in engagement with upper plate 26 and the next adjacent plate 44. Plate 48 has holes for receiving bolts 30. Moreover, plate 48 is larger in size than plates 26 and 44 and plate 48 has holes 50 for loosely receiving rods 22 as shown in FIG. 1. Preferably, plate 48 is square if plates 26 and 44 are square. Plate 48 is shown in dashed lines in FIG. 4.

The three bearing elements 16 are interconnected in the same fashion with bolts 30 as described above with respect to the connection of lower element 30 with the lower bearing element 16. In each case, a plate 48 is between and in engagement with the adjacent plates 44 with each plate 48 having holes 50 for loosely receiving rods 22.

Upper end element 18 is of the same construction as lower element 20 except upper element 18 has no rod-receiving members 32. Thus, upper element 18 has a lower plate 26, a central plate 24 and end plate 12. Plate 24 is secured by welding or by bolts to the adjacent plates 12 and 26. Bolts 30 interconnect plate 26 of upper element 18 with a plate 48 and with plate 44 of the uppermost bearing element 16.

Rods 22 can all be of the same length or can be of different lengths. The rods are clamped into place in members 32 by set screws 40, and the rods extend through holes 50 of plates 48 as shown in FIG. 1. The left-hand rod in FIG. 1 is shown as being shorter than the right-hand rod. This feature shows that the rods do not necessarily have to extend the full distance between plates 12 and 14. The minimum length of a rod corresponds to a distance extending through the plate 48 immediately above the lowermost bearing element 16. If the rod lengths are different from each other, the rods must be symmetrically located about the principal axis of isolator 10. The cross-section of each rod 22 can be of any shape, preferably however, the rod cross-section is circular. To carry out the teachings of the present invention, a single rod can be used. The maximum number of rods will depend upon the space available for rod-retaining devices 32 on the upper surface of lower plate 14.

Rods 22 provide lateral stiffness for isolator 10. Thus, when the isolator is between two building parts and upon the occurrence of an earthquake or other earth tremor, the isolator will tend to be strained laterally due to the resilience of the rubber bodies of bearing elements 16. The tendency for lateral displacement of the isolator is offset by the presence of rods 20. The lengths of the rods determine the effective stiffness of the isolator. Since the lengths and diameters of the rods can be varied, the rods provide an adjustable stiffness feature for isolator 10.

The lateral stiffness $K_1$ of a group of bearing elements 16 connected to each other without rods 22 as shown in FIG. 1 can be written as follows:

$$K_1 = GA/L_c \quad (1)$$

where A is the cross-sectional area of the rubber body of each element 16, G is the shear modulus of the rubber, and $L_c$ is the total thickness of the rubber bodies 42 of all of the superimposed bearing elements 16.

In current design practice, A, G and $L_c$ can take any reasonable value between fixed boundaries. For example, G usually has a value in the range between 3 and 17 daN/cm$^2$. Its value increases with the rubber hardness. On the other hand, if it is assumed that the building part mounted on bearing elements 16 behaves like a one degree of freedom system, the natural period T of the building in a lateral direction is related to the required stiffness $K_1$ by the following equation:

$$K_1 = 4\pi^2 m/NT^2 \quad (2)$$

where m is the mass of the building part and N is the number of bearing elements 16 having stiffness $K_1$.

Setting equations 1 and 2 equal to each other, results in the following expression:

$$A/L_c = 4\pi^2 m/NGT^2 \quad (3)$$

In equation 3, the parameters m, N and T are normally fixed by the project conditions. The value of G also is typically fixed because standard bearing elements 16 can be provided after being fabricated with a fixed value for G. Thus, the right hand side of the equation 3 has a fixed value as does the left-hand side of equation 3. This fixed value results from the imposed natural period T and comes from a dynamic operating condition of bearing elements 16.

Bearing elements 16 also must meet a static condition. This means to say that they must be designed to remain stable under a vertical load. When this design is achieved, the ratio $A/L_c$ comes with a value B which is a function of the vertical load and the shear modulus G such as shown in the following equation:

$$A/L_c = B \quad (4)$$

In view of equations 3 and 4, B should be equal to the right-hand expression in equation 3; this is not usually the case, because equation 3 comes from a dynamic condition, and the value of B comes from a static condition. Thus, a fixed value for G can result in problems impossible to solve if ordinary, conventional bearings are used. A consequence of this fact is that keeping bearing elements 16 in stock for general isolation purposes will involve many different types, each type corresponding to a different isolator size with a large range of values for the shear modulus G in each size. To require such a large stock would be expensive and has not been achieved thus far. This problem can be avoided by the use of isolator 10 which permits the number and length of rods 22 to be selected.

By adding rods 22 to bearing elements 16, such as shown in FIG. 1, the lateral stiffness of isolator 10 can be expressed as follows:

$$K=K_1+K_2 \quad (5)$$

where $K_1$ is the lateral stiffness of bearing elements 16 and $K_2$ is the lateral stiffness of the rods. The stiffness K required to match the natural period T is given by the expression which is similar to equation 2 as follows:

$$K=4\pi^2 m/NT^2 \quad (6)$$

If we assume that G has a fixed value, equation 4 is still applicable for the bearing elements 16 of isolator 10 and, inserting equation 4 into equation 1, leads to the following equation:

$$K_1=BG \quad (7)$$

Inserting equations 6 and 7 into equation 5 provides an expression for $K_2$ as follows:

$$K_2=4\pi^2 m/NT^2-GB \quad (8)$$

$K_2$ must be positive as a stiffness parameter. Thus, if G has a relatively low value, the right hand side of equation 8 will be positive and the stiffness $K_2$ of rods 22 provides a means of reconcilation between the stiffness $K_1$ of bearing elements 16 and the stiffness K required by the natural period T. Clearly, equation 8 makes it possible to fabricate and store isolators with a fixed value for G. When these stored isolators are to be used, they are selected as a function of the vertical load which they must withstand and their stiffnesses are then adjusted by selection of the proper rods 22 to meet the requirements imposed by the natural period of the structure.

What is claimed is:

1. An isolator for protecting buildings and other structures from the effects of an earthquake comprising: an upper plate; a lower plate; a stack of elastic bearing elements between the upper and lower plates; means coupling the upper plate to the upper end of the lower end of the stack of bearing elements; means coupling the lower plate to the stack of bearing elements; means interconnecting each pair of adjacent bearing elements; an intermediate plate between each pair of bearing elements, respectively, the outer periphery of the intermediate plate being greater than the outer periphery of each adjacent bearing element, each intermediate plate having a plurality of spaced, outer peripheral holes therethrough, each hole being aligned with a respective hole through the next adjacent intermediate plate; and a number of rods extending through at least the aligned holes of at least a pair of the intermediate plates for providing lateral stiffness for the bearing element, the lengths of the rods differing from each other.

2. An isolator as set forth in claim 1, wherein the rods of different lengths are symmetrical about the principal axis of the isolator.

3. An isolator for protecting buildings and other structures from the effects of an earthquake comprising: an upper plate; a lower plate; a stack of elastic bearing elements between the upper and lower plates, each bearing element including a central, rubber body, and a pair of end plates, each intermediate plate being secured to and in engagement with an end plate of an adjacent bearing element; means coupling the upper plate to the upper end of the lower end of the stack of bearing elements; means coupling the lower plate to the stack of bearing elements; means interconnecting each pair of adjacent bearing elements; an intermediate plate between each pair of bearing elements, respectively, the outer periphery of the intermediate plate being greater than the outer periphery of each adjacent bearing element, there being a plurality of outer peripheral bolts for securing the end plates of adjacent bearing elements to each other and to the adjacent intermediate plates, each intermediate plate having a plurality of spaced, outer peripheral holes therethrough, each hole being aligned with a respective hole through the next adjacent intermediate plate; and means extending through at least the aligned holes of at least a pair of the intermediate plates for providing lateral stiffness for the bearing element.

4. An isolator as set forth in claim 3, wherein the axis of the bolts is substantially vertical.

* * * * *